US007435060B2

(12) United States Patent
Kim et al.

(10) Patent No.: US 7,435,060 B2
(45) Date of Patent: Oct. 14, 2008

(54) COMPRESSOR

(75) Inventors: Chul Kim, Namyangju-shi (KR); Yong Jin Yang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 747 days.

(21) Appl. No.: 10/814,164

(22) Filed: Apr. 1, 2004

(65) Prior Publication Data

US 2004/0228741 A1 Nov. 18, 2004

(30) Foreign Application Priority Data

May 15, 2003 (KR) ..... 10-2003-0031023
Aug. 13, 2003 (KR) ..... 10-2003-0056201

(51) Int. Cl.
*F04B 39/00* (2006.01)
*F02M 35/00* (2006.01)

(52) U.S. Cl. ..... 417/312; 181/229; 181/403

(58) Field of Classification Search ..... 181/229, 181/403; 417/312
See application file for complete search history.

(56) References Cited

U.S. PATENT DOCUMENTS 4,759,693 A 7/1988 Outzen
4,782,858 A * 11/1988 Fujiwara ..... 417/312
5,173,034 A * 12/1992 Riffe ..... 181/403
5,304,044 A * 4/1994 Wada et al. ..... 417/312
5,328,338 A * 7/1994 Hirano et al. ..... 417/312
5,542,824 A * 8/1996 Lee ..... 417/312
5,641,949 A * 6/1997 Yeo ..... 181/229
5,769,613 A * 6/1998 Kim ..... 181/229
6,305,912 B1 10/2001 Svendsen et al.
6,572,345 B2 * 6/2003 Seo ..... 417/312
6,641,374 B2 * 11/2003 Kim ..... 417/312
2002/0067997 A1 6/2002 Kim

* cited by examiner

*Primary Examiner*—Charles G Freay
(74) *Attorney, Agent, or Firm*—Ked & Associates LLP

(57) ABSTRACT

The present invention relates to a compressor. In one aspect of the present invention, a compressor is provided, including a cylinder having a compression chamber, a valve assembly mounted on one open end of the cylinder, and a head assembly on the valve assembly. The head assembly includes a suction muffler, a head plate, a head cover, a damping pipe, and a discharge muffler. The suction muffler includes at least one wing on an outside surface of an outlet part thereof, and the head plate includes a first cut away part for inserting the wing of the outlet part. The head cover is closed fastened to the head plate so as to press down the suction muffler. In the meantime, the head plate includes a recess for inserting the middle part of the damping pipe therein to hold the damping pipe, and the discharge muffler is fitted to one surface of the head plate to surround the damping pipe.

12 Claims, 9 Drawing Sheets

COMPRESSOR

This application claims the benefit of the Korean Application Nos. P2003-31023 filed on May 15, 2003, P2003-56201 field on Aug. 13, 2003, which are hereby incorporated by reference.

BACKGROUND OF THE INVENTION

1. Field of the Invention

The present invention relates to compressors, and more particularly, to a compressor having an improved structure that enables easy mounting of a suction muffler, and a discharge muffler, on a head assembly of a compression cylinder.

2. Background of the Related Art

The compressor boosts a pressure of a working fluid by receiving a power from an electric motor or a turbine, and applying a compressive work to air, refrigerant, or other special gas. The compressor is widely used starting from home appliances, to plant industries in the fields of air conditioners, or refrigerators.

Depending on methods of compression, there are positive displacement compressors, and dynamic compressors, or turbo compressors. The positive displacement compressors boost a pressure by reduction of a volume, and have reciprocating compressors, and rotary compressors.

The reciprocating compressor, compressing the working fluid by means of a piston reciprocating inside of a cylinder, is advantageous in that a high compression efficiency can be provided by using comparatively simple mechanical components.

The rotary compressor, compressing the working fluid by means of a roller revolved inside of a cylinder with an eccentricity, can provide a high compression efficiency at a speed lower than the reciprocating compressor.

FIG. 1 illustrates a typical example of the reciprocating compressor, referring to which the reciprocating compressor will be described in more detail.

Referring to FIG. 1, two pieces of cases 1 assembled together form an enclosed space, in which a frame 2 is provided. The frame 2 is supported on the cases 1 with springs 4.

There is a crank shaft 6 mounted passed through a central part of the frame 2. For this, there is a boss 3 in the central part of the frame 2 for stable support of the crank shaft 6.

The crank shaft 6 mounted thus, is rotated by the motor 5, which is provided with a stator 5*a* and a rotor 5*b*. The stator 5*a* is fixed to the frame 2, and the rotor 5*b* is fixed to the crank shaft 6. Since the rotor 5*b* positions inside of the stator 5*a*, the crank shaft 6 rotates together with the rotor 5*b* when power is provided to the motor 5.

Referring to FIG. 1, there is an eccentric pin 6*a* on top of the crank shaft 6 at an eccentric position from a rotation center of the crank shaft 6. There is a balance weight 6*b* on top of the crank shaft at an opposite side of the eccentric pin 6*a*. The balance weight 6*b* prevents the crank shaft 6 from shaking due to weight of the eccentric pin 6*a* during rotation of the crank shaft 6.

In the meantime, there is lubricating oil held on a bottom of the case 1, and the crank shaft 6 has oil passages 6*c* inside of the crank shaft 6. Accordingly, when the crank shaft 6 rotates, lubricating oil moves following the oil passage 6*c*, and sprayed from the top of the crank shaft 6. According to this, the lubricating oil is supplied to all mechanically operative components in the case 1.

There are a cylinder 10 having a compression chamber 11 therein in one side part of top of the frame 2, and a piston 15 in the compression chamber 11 having one end coupled to the eccentric pin 6*a*. Therefore, when the crank shaft 6 rotates, the piston 15 reciprocates within the compression chamber 11.

There is a valve assembly 20 mounted on an end of the cylinder 10 for controlling flow of a working fluid, for an example, refrigerant introduced into the compression chamber 11, compressed therein, and discharged therefrom, and there is a head assembly 30 on top of the valve assembly 20 for guiding flow of the working fluid.

In the meantime, referring to FIGS. 2 and 3, structures of the valve assembly 20 and the head assembly 30 can be understood more easily. Therefore, the valve assembly 20 and the head assembly 30 will be described in more detail with reference to the drawings. Examples illustrated in FIGS. 2 and 3 have slightly different structures.

The valve assembly 20 is provided with a suction valve 21, a valve plate 22, a discharge valve 23, and a gasket 24 (see FIG. 3). The valve plate 22 has a suction port 22*a* for drawing the working fluid, i.e., the refrigerant, into the compression chamber 11 of the cylinder 10, and a discharge port 22*b* for discharging the refrigerant to an outside of the compression chamber 11.

The suction valve 21 is between the valve plate 22 and the cylinder 10, and operative by an elastic force and a pressure difference for opening/closing the suction port 22*a*. The discharge valve 23 is opposite to the suction valve 21 to face the valve plate 22 for opening/closing the discharge port 22*b* by a pressure difference and an elastic force. The gasket 24 is provided between the discharge valve 23 and the head assembly 30 for preventing leakage of the refrigerant.

The head assembly 30 is provided with a head plate 31 adjacent to the gasket 24, a head cover 32 attached to the head plate 31, and a suction muffler 33 and a discharge muffler 34 (not shown in FIG. 2). In the meantime, the head assemblies illustrated in FIGS. 2 and 3 have different structures, which will be described.

Referring to FIG. 2, the head plate 31 and the head cover 32 forms a discharge chamber 32*a* for discharging working fluid, i.e. the refrigerant compressed in the compression chamber 11. Both the head plate 31 and the heat cover 32 have fastening holes 25 for bolts 7. The valve assembly 20 and the cylinder 10 also have the fastening holes 25. Therefore, the head assembly 30 and the valve assembly 20 are fastened to the cylinder 10 with the bolts 7, rigidly.

Both the head plate 31 and the head cover 32 have cut away portions 35 respectively, to expose the suction port 22*a* of the valve assembly 20 as shown in FIG. 2. The suction port 22*a* has a discharge part 33*a* of the suction muffler 33 connected thereto. For this, the discharge part 33*a* is inserted in the cut away part 35, and a clamp 36 is fastened to cover the discharge part 33*a*. The clamp 36 is fastened with the bolts 7 passed through the fastening holes 25 on both sides of the discharge part 33*a*, to fasten the suction muffler 33, rigidly.

In the meantime, in the head assembly 30 shown in FIG. 3, the head plate 31 has the suction muffler 33 fixed thereto, and the suction muffler 33 has a suction pipe 33b connected thereto (see FIG. 4). The head plate 31 had the head cover 32 brazed thereto.

Referring to FIG. 4, there is a suction guide 32*b* between the head plate 31 and the head cover 32, for guiding the refrigerant from the suction muffler 33 to the compression chamber 11. As shown in FIG. 4, the discharge chamber 32*a* between the head plate 31 and the head cover 32 is filled with the refrigerant discharged from the compression chamber 11.

Referring to FIGS. 3 and 4, the head plate 31 has the discharge muffler 34, which is in communication with the discharge chamber 32*a*, connected thereto. There is a damping pipe 37 that makes the discharge chamber 32*a* and the discharge muffler 34 in communication, and has a form wound many times in a circular form. There is a discharge pipe 34*a* connected to the discharge muffler 34. Therefore, the refrigerant filled in the discharge chamber 32*a* is introduced into the discharge muffler 33 through the damping pipe 37, and discharged to the discharge pipe 37.

The operation of the compressor will be described.

When power is provided to the motor 5, the crank shaft 6 rotates together with the rotor 5*b*, and the piston 15 connected to the eccentric pin 6*a* reciprocates within the cylinder 10. In the meantime, the suction muffler 33 is filled with refrigerant through the suction pipe 33*b*.

If the piston 15 moves to increase a volume of the compression chamber 11, with consequential decrease of a pressure of the compression chamber 11, the suction valve 21 is opened, such that the compression chamber 11 draws in the refrigerant from the suction muffler 33 through the suction guide 32*b*.

If the piston 15 reverses to decrease a volume of the compression chamber 11, with consequential increase of the pressure of the compression chamber 11 as the refrigerant is compressed. When the pressure of the compression chamber 11 rises over a certain pressure, the discharge valve 23 is opened, such that high pressure refrigerant fills the discharge chamber 32*a*, and therefrom flows to the discharge pipe 33*b* through the discharge muffler 33.

However, the related art compressor has the following problems.

First, in the case of the head assembly 30 shown in FIG. 2, the use of the clamp 36 for mounting the suction muffler 33 increases a number of components. The handling of the bolts and tool in a state the clamp 36 and the suction muffler 33 are held in position for fastening the clamp 36 to the head cover 32 leads assembly cumbersome, and deformation of the clamp 36, resulting in a poor accuracy of assembly, causes leakage of the refrigerant.

Next, in a case of head assembly 30 shown in FIGS. 3--5, the head plate 31, the head cover 32, the suction muffler 33, and the discharge muffler 34 are assembled with brazing, which causes defects because holding the damping pipe in position during the brazing is difficult, causing imperfect communication between the damping pipe 37 and the discharge chamber 32a, to introduce a portion of the refrigerant from the discharge chamber 32a to the discharge muffler 34, directly. According to this, pulsation and noise of the refrigerant can not be eliminated from the compression chamber 11 properly, to cause emission of loud noise from the compressor, with drop of a performance of the compressor.

SUMMARY OF THE INVENTION

Accordingly, the present invention is directed to a compressor that substantially obviates one or more of the problems due to limitations and disadvantages of the related art.

An object of the present invention is to provide a compressor of an improved structure which has a small number of components and enables an easy assembly.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the compressor includes a cylinder having a compression chamber for a piston to reciprocate therein, a valve assembly mounted on one open end of the cylinder, for controlling flow of a working fluid being drawn into, or being discharged from the compression chamber, and a head assembly for guiding flow of the working fluid being drawn into, or being discharged from the compression chamber, including a suction muffler having at least one wing on an outside surface thereof with an outlet part for introducing the working fluid into the compression chamber, a head plate having a first cut away part with the outlet part inserted therein, the head plate fitted on the valve assembly, and a head cover for holding the suction muffler by closely fastened to the head plate to press the wing.

In other aspect of the present invention, there is provided a compressor including a cylinder having a compression chamber for a piston to reciprocate therein, a valve assembly mounted on one open end of the cylinder, for controlling flow of a working fluid being drawn into, or being discharged from the compression chamber, and a head assembly including a head plate fitted on the valve assembly having an opening and a hole for passing the working fluid discharged from the compression chamber, and a recess in one surface thereof, a head cover on the head plate having a discharge chamber for guiding the working fluid introduced thereto through the opening to the hole, a damping pipe inserted in, and held at the recess having one end inserted in the hole, and a discharge muffler fitted to one side of the head plate so as to surround the damping pipe.

In another aspect of the present invention, there is provided a compressor including a cylinder having a compression chamber for a piston to reciprocate therein, a valve assembly mounted on one open end of the cylinder, for controlling flow of a working fluid being drawn into, or being discharged from the compression chamber, and a head assembly for guiding flow of the working fluid being drawn into, or being discharged from the compression chamber, including a suction muffler having at least one wing on an outside surface thereof with an outlet part for introducing the working fluid into the compression chamber, a head plate fitted on the valve assembly having a first cut away part with the outlet part inserted therein, an opening and a hole for passing the working fluid discharged from the compression chamber, and a recess in one surface thereof, a head cover for holding the suction muffler by closely fastened to the head plate to press the wing having a discharge chamber for guiding the working fluid introduced thereto through the opening to the hole, and a discharge muffler fitted to one side of the head plate so as to surround the damping pipe.

The first cut away part includes a holding slot for inserting the wing therein.

The head cover includes a second cut away part for inserting the outlet part therein, and a part of the head cover adjacent to the second cut away part presses down, and hold the wing.

There are one pair of the wings provided on opposite sides of the outlet part symmetry to each other.

The wing includes a projection projected from a surface in contact with the head cover.

The projection has a lower width connected to the wing lager than an upper width in contact with the head cover.

The projection is pressed down on the head cover when the head cover is fastened to the head plate. In this instance, the wing has a thickness the same with the head plate when the projection is pressed down.

The head cover covers an upper part of the outlet part.

The recess is adjacent to the hole.

The damping pipe has a middle part wound many times in a circular form.

The recess has a width the same with the middle part of the damping pipe.

The recess has a curved bottom surface with a curvature the same with an outside circumferential surface of the middle part of the damping pipe.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

The compressor of the present invention includes a cylinder, a valve assembly, and a head assembly.

The cylinder has a compression chamber formed therein, in which a piston is inserted. The piston has one end connected to a crank shaft rotated by a motor, to reciprocate in the compression chamber when the motor is in operation.

The valve assembly is mounted on an open end of the compression chamber, for controlling flow of a working fluid, for an example, refrigerant being drawn into, or being discharged from, the compression chamber. For this, the valve assembly includes a valve plate having a suction port and a discharge port, a suction valve for opening/closing the suction port, a discharge valve for opening/closing the discharge port, and a gasket for preventing leakage of the working fluid.

Figure 1:
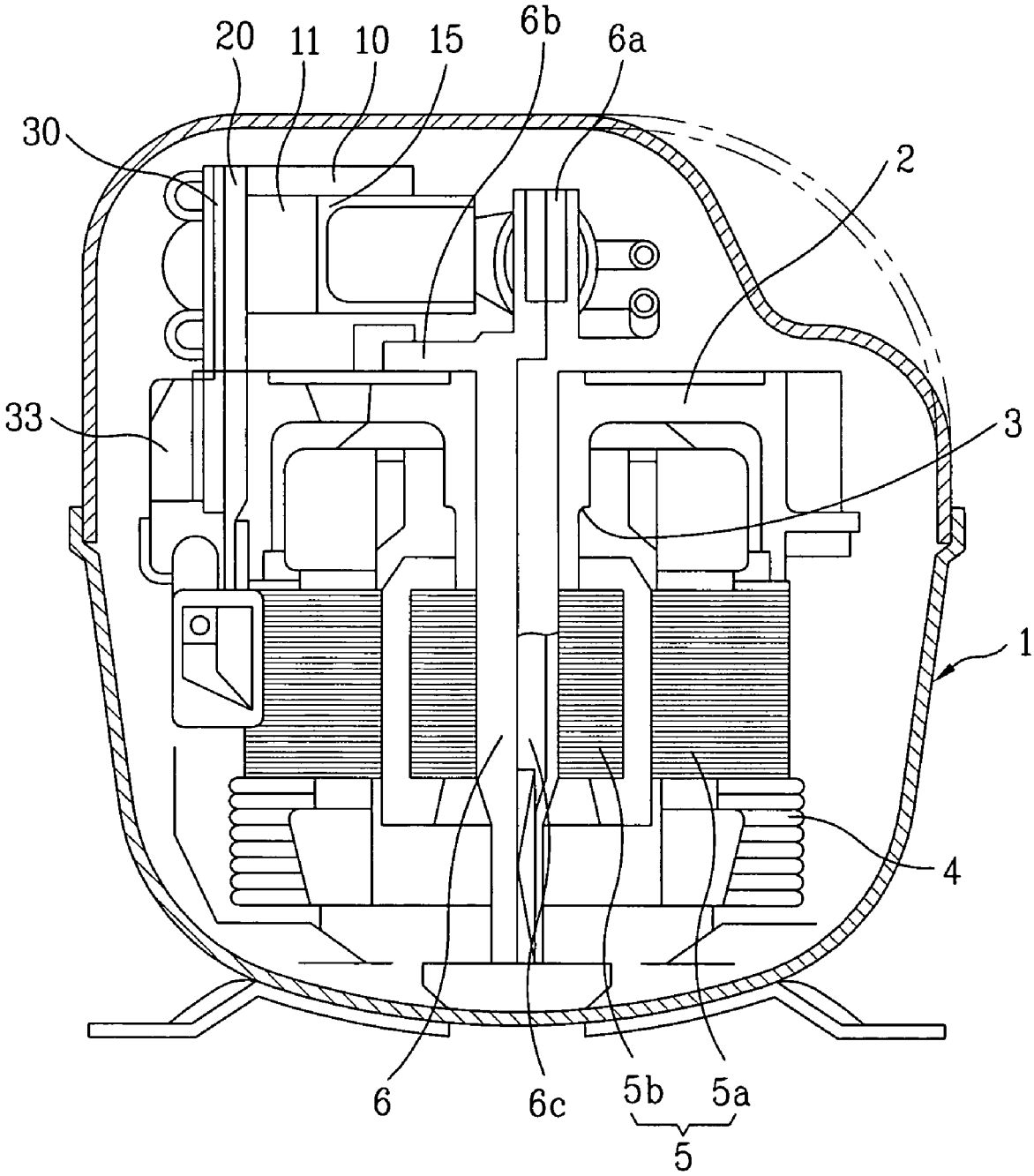
FIG. 1 Prior Art
FIG. 1 illustrates a section of a related art compressor.
Figure 2:
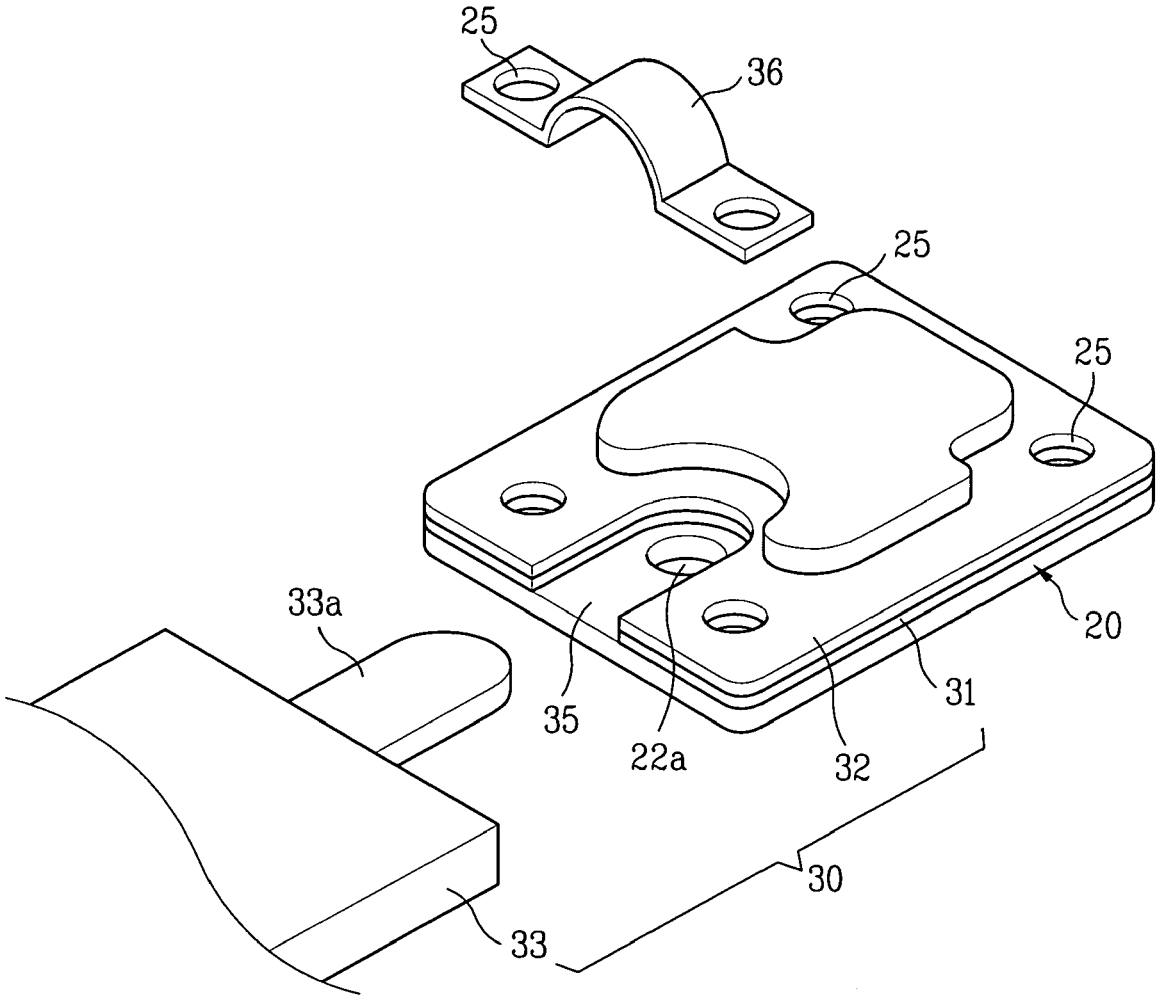
FIG. 2 Prior Art
FIG. 2 illustrates a partial disassembled perspective view of an example of an assembling structure of a suction muffler, a valve assembly, and a head assembly of a related art compressor.
Figure 3:
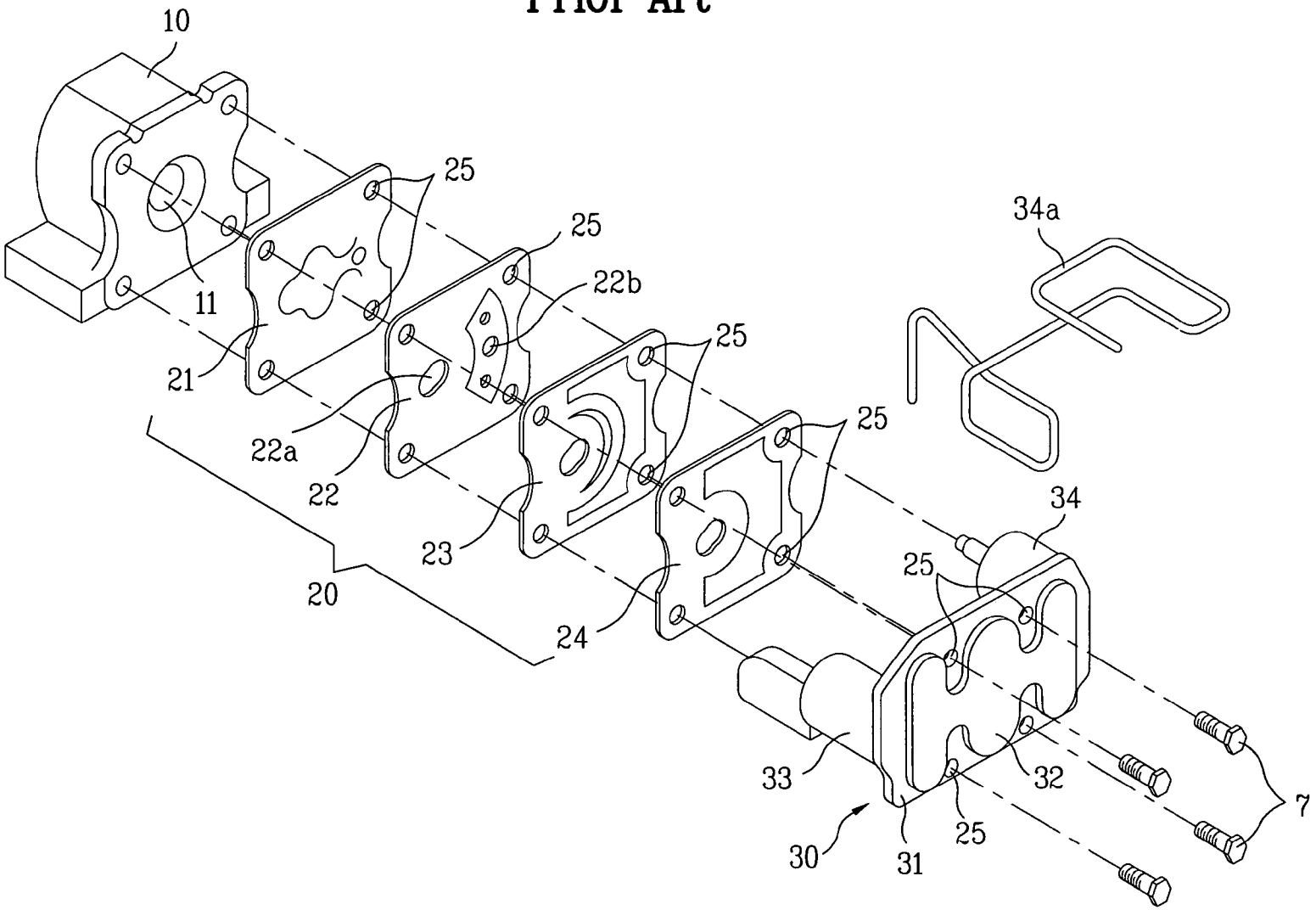
FIG. 3 Prior Art
FIG. 3 illustrates a partial disassembled perspective view of another example of an assembling structure of a cylinder block, a valve assembly, and a head assembly of a related art compressor.
Figure 4:
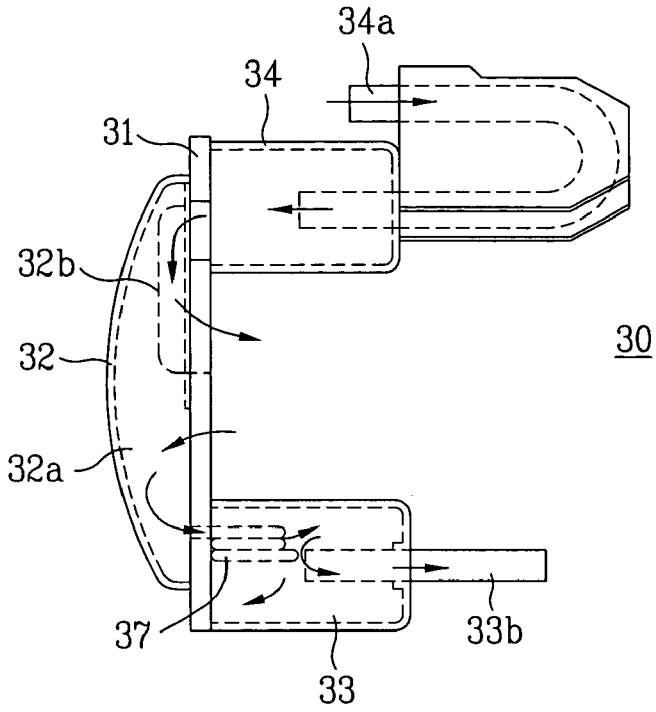
FIG. 4 Prior Art
FIG. 4 illustrates a section of the head assembly in FIG. 3.
Figure 5:
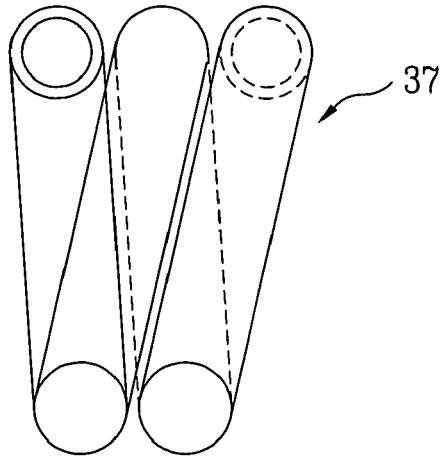
FIG. 5 Prior Art
FIG. 5 illustrates a side view of a damping pipe of the head assembly in FIG. 4.

In the meantime, structures of the cylinder and the valve assembly of the compressor of the present invention are similar to the ones described with reference to FIGS. 1 and 3. Therefore, any further description of the structures will be omitted, and a structure of the head assembly will be described with reference to the attached drawings.

The head assembly 300 (see FIG. 6) of the present invention includes a head plate 310, and a head cover 320. The head assembly 300 is mounted on the valve assembly 200 (see FIG. 11), for guiding flow of the working fluid being drawn into the compression chamber 110 (see FIG. 11), or being discharged from the compression chamber 110.

The head assembly 300 has a suction muffler 330 and a discharge muffler 340 fitted thereto, and all the related art problems are solved according to fitting structures in which the suction muffler 330 and the discharge muffler 340 are fitted to the head plate 310 of the head assembly 300.

Figure 6:
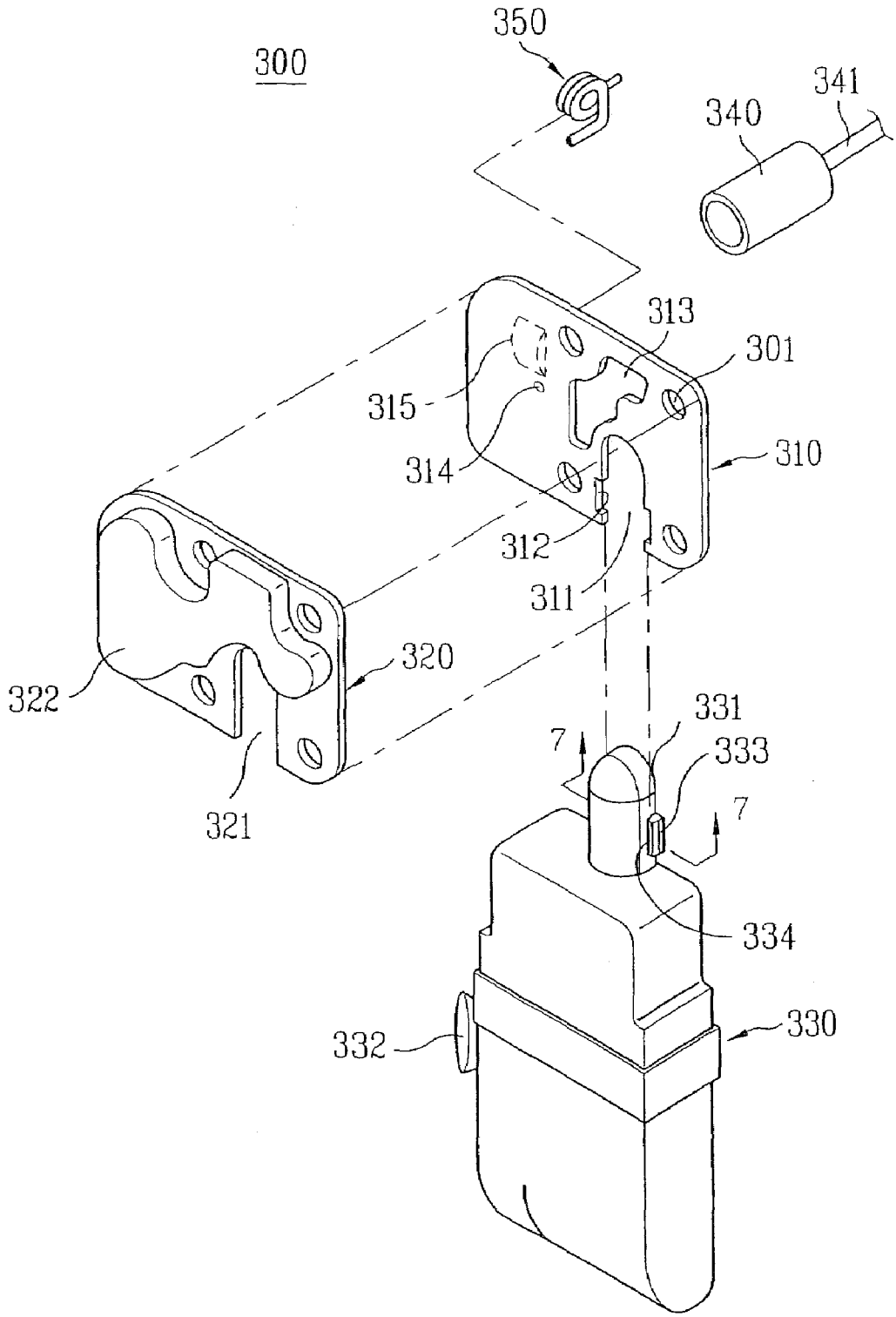
FIG. 6 illustrates a partial disassembled perspective view of an assembling structure of a suction muffler, a head assembly, and a discharge muffler of a compressor in accordance with a preferred embodiment of the present invention.

Referring to FIG. 6, the fitting structure of the suction muffler 330 will be described. For reference, the suction muffler 330 attenuates noise and pulsation of refrigerant occurred during the working fluid, such as refrigerant of refrigerator or an air conditioner, is introduced into the compression chamber 110 from an outside of the compressor through the suction muffler 330.

For this, the suction muffler 330 has a passage formed therein for flow of the working fluid, with an inlet part 332 in one side of the suction muffler 330. The inlet part 332 has a suction pipe (not shown), such as a refrigerant pipe, connected thereto, for introduction of the working fluid into the suction muffler 330.

Then, the working fluid is discharged through an outlet part 331, and introduced into the compression chamber 110 through the valve assembly 200. As shown in FIG. 6, the outlet part 331 is projected from the suction muffler 330, and has an outlet opening 335 as shown in FIG. 7.

Figure 7:
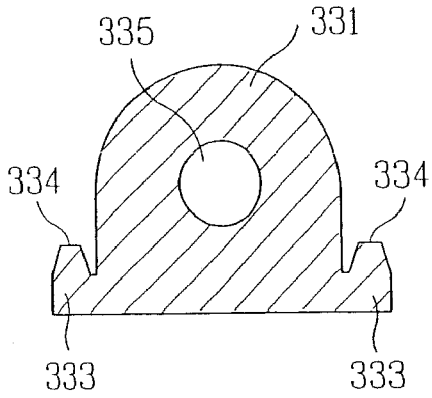
FIG. 7 illustrates a section across a line I-I in FIG. 6.

Referring to FIGS. 6 and 7, in the present invention, at least one wing 333 is provided at opposite sides of an outside of the outlet part 331, for an example, one pair of the wings 333 are provided at opposite sides of the outlet part in symmetry to each other.

In the meantime, referring to FIG. 6, the head plate 310, closely fitted on the valve assembly 200 (see FIG. 11), has a first cut away part 311. The first cut away part 311 has a width and a length cut into a side of the head plate 310.

The first cut away part 311 has the outlet part 331 of the suction muffler 330 inserted, and fitted therein. Accordingly, the cut away part 311 has holding slots 312 for inserting the wings 333 at sides of the outlet part 331. This structure holds the outlet part 331 inserted in the first cut away part 311, such that the outlet part 331 can not move along a length, or width direction of the first cut away part 311.

The first cut away part 311 is arranged at a position to be in communication with the suction port (not shown) when the head plate 310 is fitted on the valve assembly 200, so that an inside of the suction muffler 330 and the compression chamber 110 are in communication when the suction valve (not shown) is opened for introduction of the working fluid from the suction muffler 330 to the compression chamber 110.

Referring to FIG. 6, the head plate 310 has an opening 313. Accordingly, the working fluid compressed in the compression chamber 110 escapes through the opening 313 from the compression chamber 110 to an outside thereof. Moreover, the head plate 310 has a hole 314 for passing the working fluid escaped through the opening 313. The hole 314 has the discharge muffler 340 or the discharge pipe 341 connected thereto.

In the meantime, the head cover 320 is closely attached to the head plate 310 and guides the working fluid discharged through the opening 313 to the hole 314. For this, the head cover 320 has a discharge chamber 322 as shown in FIG. 6.

Thus, the outlet part 331 of the suction muffler 330 is inserted in the first cut away part 311, and the head cover 320 is attached to the head plate 310. Therefore, the head cover 320 is held at the outlet part of the suction muffler 330, particularly the wings 333.

Though not shown, the head cover 320 may be fitted to cover top of the outlet part 331 of the suction muffler 330. In this case, it is preferable that one side of the head cover 320 has a hollow for surrounding the outlet part 331.

However, referring to FIG. 6, the head cover 320 may have a second cut away part 321. The second cut away part 321 has a form similar to the first cut away part 311, except that the second cut away part 321 is provided with no separate holding slots for the wings 333. Therefore, when the head cover 320 is attached to the head plate 310, a part of the head cover 320 adjacent to an edge of the second cut away part 321 presses down, and hold the wings 333.

In the meantime, the present invention suggests a structure for firm holding of the outlet part 331 of the suction muffler 330, further. For this, as shown in FIGS. 6 and 7, the wings 333 are provided with projections 334. The projection is provided to a surface that is to contact with the head cover 320, i.e., an upper surface of the wing 333, so that the projection 334 is pressed down by the head cover 320 when the head assembly 300 is assembled.

Referring to FIG. 7, the projection 334 has a lower width connected to the wing 333 larger than an upper width in contact with the head cover 320. This is for easy press down of the projection 334 by the head cover 320 when the head cover 320 is attached to the head plate 310.

Figure 11:
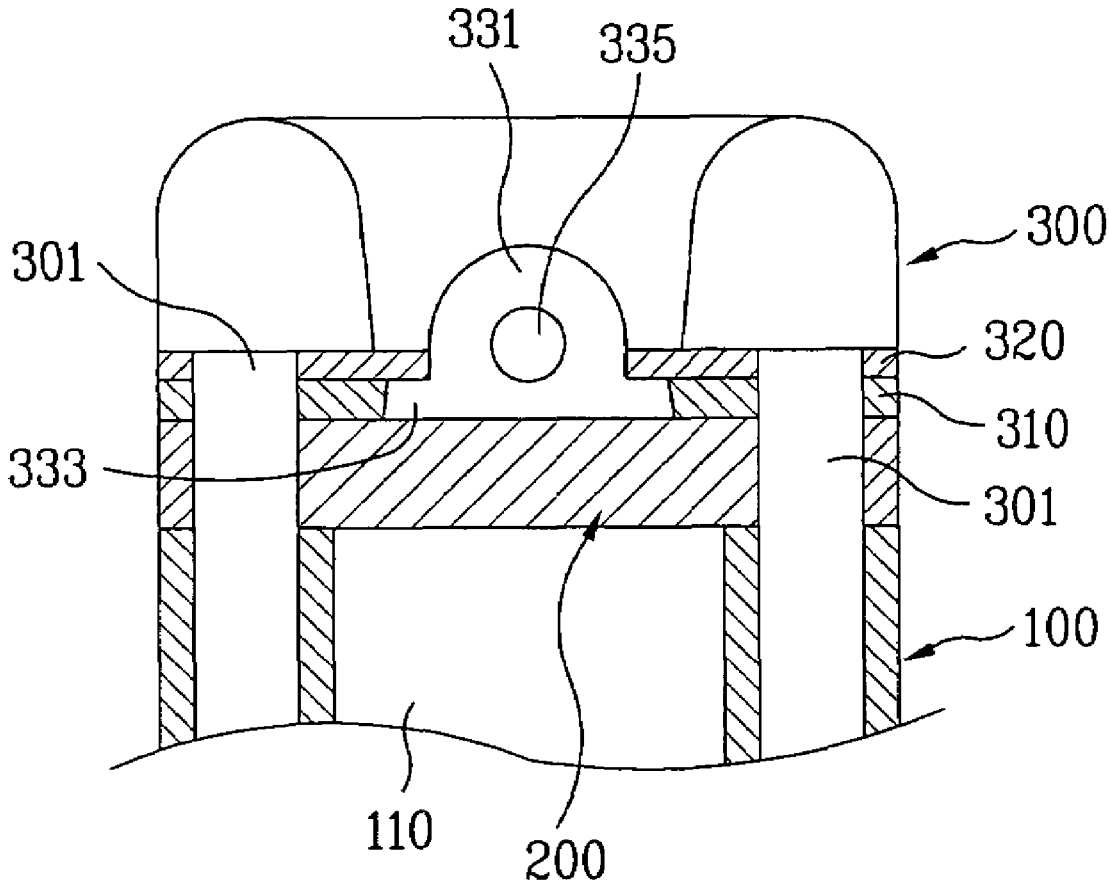
FIG. 11 illustrates a section showing an assembly of the head assembly, the valve assembly, and the cylinder in FIG. 6, schematically.

In the meantime, referring to FIG. 11, it is preferable that a thickness of the wing 333 is substantially same with a thickness of the head plate 310 when the projection 334 is pressed.

Above structure makes the outlet part 331 hardly movable since the wing 333 is pressed down by the head cover 320. According to this, the suction muffler 330 is rigidly held.

In the meantime, the head assembly 300 of the present invention may be provided with a discharge muffler 340. A fitting structure of the discharge muffler 340 will be described in more detail.

Referring to FIG. 6, there is a recess 315 in a surface of the head plate 310, in more detail, opposite to a surface facing the head cover 320. The recess 315 is adjacent to the hole 314 in the head plate 310.

The recess 315 has a damping pipe 350 inserted therein. The damping pipe 350 has one end connected to the hole 314 for guiding the working fluid from the discharge chamber 322 to the discharge muffler 340.

Referring to FIG. 6, the damping pipe 350 fitted thus has a middle part thereof wound in a circular form for many times, for lengthening a flow passage of the working fluid to reduce the pulsation and noise of the working fluid, effectively.

Figure 8:
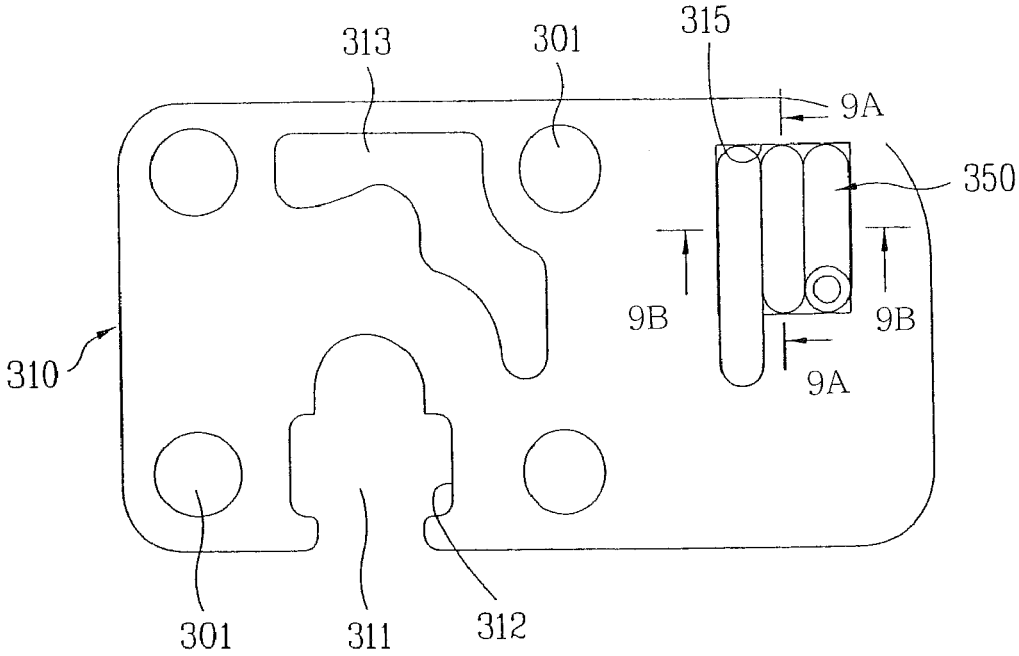
FIG. 8 illustrates a plan view showing fitting of a damping pipe to a head plate in the head assembly in FIG. 6.

Referring to FIG. 8, the middle part of the damping pipe 350 is inserted in the recess 315. For this, as shown in FIG. 9B, it is preferable that a width of the recess 315 is the same with or slightly smaller than the middle part of the damping pipe 350.

Figure 9A:
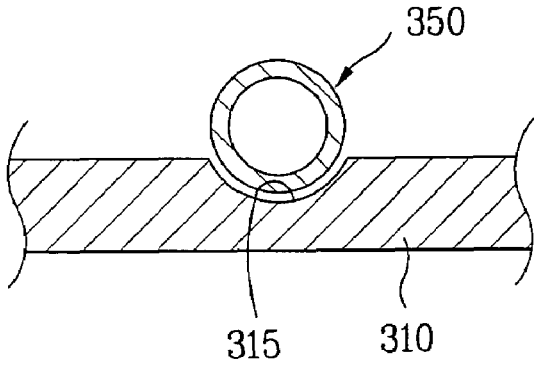
FIG. 9A illustrates a section across line II-II in FIG. 8.
Figure 9B:
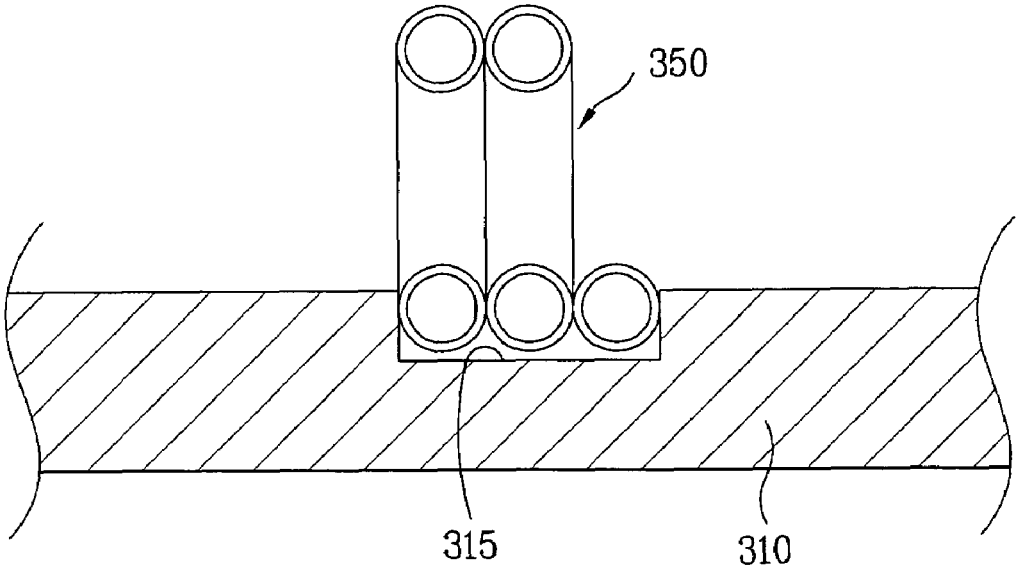
FIG. 9B illustrates a section across line III-III in FIG. 8.

Moreover, referring to FIG. 9A, for stable fitting of the middle part of the damping pipe 350 to the recess 315, it is preferable that a bottom surface of the recess 315 has a curvature the same with, or similar to, the outside circumferential surface of the middle part. However, it is not necessarily required that the bottom surface of the recess 315 is a curved surface.

In the meantime, the discharge muffler 340 is fitted to a surface of the head plate 310 having the recess 315 formed therein, to surround the damping pipe 350. It is preferable that the discharge muffler 340 is fitted to surround, not only the damping pipe 350, but also both the hole 314 and the recess 315.

The provision of the damping pipe 350 and the discharge muffler 340 thus can attenuate the pulsation and noise of the working fluid discharged from the compression chamber 110 to the discharge chamber 322 as the working fluid passes the damping pipe 350 and the discharge muffler 340.

A process for assembling the head assembly 300 of the present invention will be described in detail.

Figure 10:
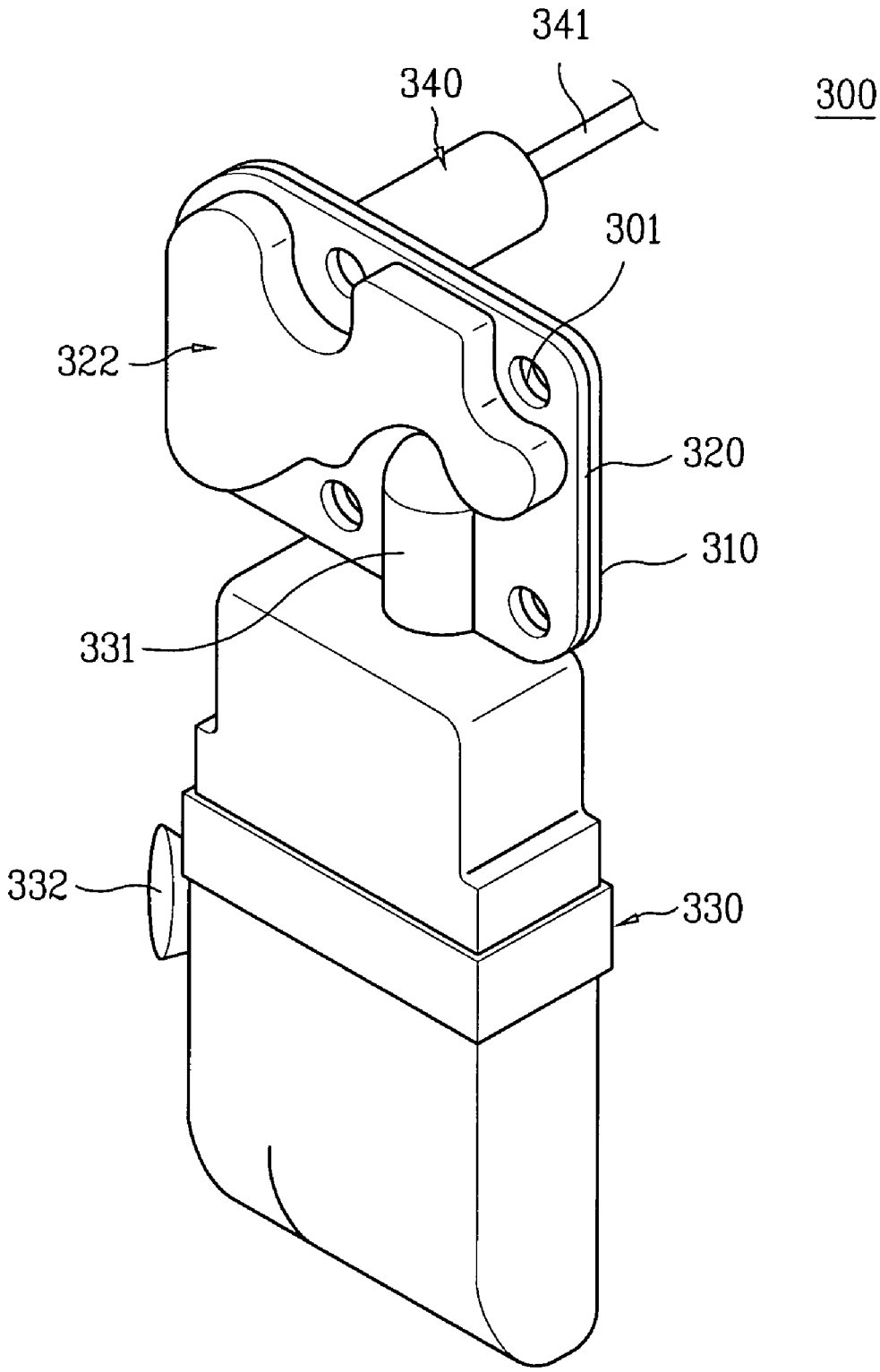
FIG. 10 illustrates a perspective view an assembly of the suction muffler, the head muffler, and the discharge muffler in FIG. 6.

At first, the head plate 310, the head cover 320, and the discharge muffler 340 are attached together with brazing. For this, as shown in FIG. 10, the damping pipe 350 is seated on the recess 315 of the head plate 310 and held. Of course, in this instance, it is in a state one end of the damping pipe 350 is connected to the hole 314.

Once the damping pipe 350 is seated, the discharge muffler 340 is connected to the head plate 310. In this instance, a piece of base metal is provided between the head plate 310 and the head cover 320, between the damping pipe 350 and the recess 315, and between the head plate 310 and the discharge muffler 340, for brazing.

When an assembly assembled thus is heated in a brazing furnace, the base metal infiltrates into connection parts of the components, thereby finishing the brazing.

Upon finishing the brazing, the assembly having brazing thereof finished, the suction muffler 330, the valve assembly 200, and the cylinder 100 are assembled. For this, as shown in FIG. 10, the outlet part 331 of the suction muffler 330 is inserted in the first cut away part 311 of the head plate 310.

In this instance, the outlet part 331 is moved from an opposite side of the head cover 320 toward the head cover 320 until the outlet part 331 is inserted in the first cut away parts 311, when the wings 333 are inserted in the holding slots 312 respectively, and the projections 334 on the wings 333 hold a part of the head cover 320.

Next, in a state the outlet part 331 of the suction muffler 330 is inserted in the first cut away part 311, the head assembly 300 is mounted on the valve assembly 200. In this instance, the head assembly 300, the valve assembly 200, and the cylinder are fastened with bolts (not shown) inserted in bolt holes 301 formed therein, respectively.

Referring to FIG. 11, when the bolts are fastened, the head cover 320 presses down the projections 334 on the wings 333. According to this, a thickness of the wings 333 becomes the same with, or similar to a thickness of the head plate 310, to fasten the wings 333 of the outlet part 331 between the valve assembly 200 and the head cover 320, tightly.

Once the bolts are fastened completely, assembly of the head assembly 300, the valve assembly 200, and the cylinder 100 are finished.

The operation principle and process of the foregoing compressor of the present invention, similar to ones described with reference to FIGS. 1 to 5, will be omitted.

As has been described, the compressor of the present invention has the following advantages.

First, the suction muffler is held by the head cover, the head plate, and the valve assembly without any separate components, such as a bracket, to reduce a number of components, and make assembly easy, to improve a productivity.

Second, the holding of the outlet part of the suction muffler in a state the projections on the wings are pressed down permits a tight fastening of the suction muffler.

Third, the provision of a recess in the head plate for holding the damping pipe permits brazing of the head cover, the head plate, and the damping pipe after the damping pipe is held at an accurate position. Therefore, the components can be attached accurately, and easily, to reduce defects. Moreover, no defect permits to reduce pulsation and noise of the working fluid.

It will be apparent to those skilled in the art that various modifications and variations can be made in the present invention without departing from the spirit or scope of the invention.

For an example, an embodiment in which both the suction muffler and the discharge muffler are mounted on the head assembly is described. However, the suction muffler and the discharge muffler may be mounted on the head assembly, independently.

That is, even if the suction muffler of the present invention is provided to the head assembly, the head assembly may have a discharge muffler having a structure different from above structure, and vice versa.

Thus, it is intended that the present invention cover the modifications and variations of this invention provided they come within the scope of the appended claims and their equivalents.

What is claimed is:

1. A compressor comprising:

a cylinder having a compression chamber for a piston to reciprocate therein;

a valve assembly mounted on one open end of the cylinder, for controlling flow of a working fluid being drawn into, or being discharged from the compression chamber; and a head assembly including;

a head plate fitted on the valve assembly having an opening and a hole for passing the working fluid discharged from the compression chamber, and a recess in one surface thereof, a head cover on the head plate having a discharge chamber for guiding the working fluid introduced thereto through the opening to the hole, a damping pipe inserted in, and held at the recess having one end inserted in the hole, and a discharge muffler fitted to one side of the head plate so as to surround the damping pipe.

2. The compressor as claimed in claim 1, wherein the recess is adjacent to the hole.

3. The compressor as claimed in claim 1, wherein the damping pipe includes a middle part wound many times in a circular form.

4. The compressor as claimed in claim 1, wherein the recess has a width the same with a width of the middle part of the damping pipe.

5. The compressor as claimed in claim 3, wherein the recess has a bottom surface with a curvature the same with an outside circumferential surface of the middle part of the damping pipe.

6. A compressor comprising:

a cylinder having a compression chamber for a piston to reciprocate therein;

a valve assembly mounted on one open end of the cylinder, for controlling flow of a working fluid being drawn into, or being discharged from the compression chamber; and a head assembly for guiding flow of the working fluid being drawn into, or being discharged from the compression chamber, including;

a suction muffler having at least one wing on an outside surface thereof with an outlet part for introducing the working fluid into the compression chamber, a head plate fitted on the valve assembly having a first cut away part with the outlet part inserted therein, an opening and a hole for passing the working fluid discharged from the compression chamber, and a recess in one surface thereof, a head cover for holding the suction muffler being closely fastened to the head plate to press the at least one wing the head cover having a discharge chamber for guiding the working fluid introduced thereto through the opening to the hole, and a discharge muffler fitted to one side of the head plate so as to surround a damping pipe.

7. The compressor as claimed in claim 6, wherein the first cut away part includes a holding slot for inserting the at least one wing therein.

8. The compressor as claimed in claim 6, wherein the head cover includes a second cut away part for inserting the outlet part therein, and a part of the head cover adjacent to the second cut away part presses down, and hold at least one the wing.

9. The compressor as claimed in claim 6, wherein the at least one wing includes a projection projected from one surface so as to be pressed down by the head cover when the head cover is fastened to the head plate.

10. The compressor as claimed in claim 9, wherein the at least one wing has a thickness the same with the head plate when the projection is pressed down.

11. The compressor as claimed in claim 6, wherein the damping pipe has a middle part having a form wound many times in a circular form, and the recess has a width the same with the middle part of the damping pipe.

12. The compressor as claimed in claim 11, wherein the recess has a curved bottom surface having a curvature the same with an outside circumferential surface of the middle part of the damping pipe.

* * * * *